US009365797B2

(12) United States Patent
Iwai

(10) Patent No.: US 9,365,797 B2
(45) Date of Patent: Jun. 14, 2016

(54) LUBRICANT OIL COMPOSITION FOR TRANSMISSIONS

(71) Applicant: Toshiaki Iwai, Ichihara (JP)

(72) Inventor: Toshiaki Iwai, Ichihara (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 14/358,541

(22) PCT Filed: Nov. 16, 2012

(86) PCT No.: PCT/JP2012/079742
§ 371 (c)(1),
(2) Date: May 15, 2014

(87) PCT Pub. No.: WO2013/073651
PCT Pub. Date: May 23, 2013

(65) Prior Publication Data

US 2014/0315771 A1 Oct. 23, 2014

(30) Foreign Application Priority Data

Nov. 16, 2011 (JP) ..... 2011-250268

(51) Int. Cl.

| | |
|---|---|
| ***C10M 157/00*** | (2006.01) |
| ***C10M 143/00*** | (2006.01) |
| ***C10M 169/04*** | (2006.01) |
| ***C10M 171/00*** | (2006.01) |
| *C10M 145/14* | (2006.01) |

(52) U.S. Cl.
CPC ..... *C10M 169/041* (2013.01); *C10M 169/044* (2013.01); *C10M 171/00* (2013.01); *C10M 143/00* (2013.01); *C10M 145/14* (2013.01); *C10M 2203/1006* (2013.01); *C10M 2203/108* (2013.01); *C10M 2203/1025* (2013.01); *C10M 2205/00* (2013.01); *C10M 2205/0285* (2013.01); *C10M 2209/084* (2013.01); *C10N 2220/021* (2013.01); *C10N 2220/022* (2013.01); *C10N 2220/082* (2013.01); *C10N 2230/02* (2013.01); *C10N 2230/06* (2013.01); *C10N 2230/68* (2013.01); *C10N 2240/04* (2013.01); *C10N 2240/045* (2013.01)

(58) Field of Classification Search
CPC ..... C10M 2203/1006; C10M 2203/1025; C10M 2205/02
USPC ..... 508/473, 591
See application file for complete search history.

(56) References Cited

U.S. PATENT DOCUMENTS

| | | | | |
|---|---|---|---|---|
| 5,858,935 | A | 1/1999 | Watts et al. | |
| 2006/0105921 | A1 | 5/2006 | Arimoto et al. | |
| 2006/0135378 | A1* | 6/2006 | Takahashi et al. | C10M 169/04 508/433 |
| 2007/0191239 | A1 | 8/2007 | Matsuoka et al. | |
| 2011/0034358 | A1 | 2/2011 | Komatsubara | |
| 2012/0316092 | A1* | 12/2012 | Fujita et al. | 508/162 |

FOREIGN PATENT DOCUMENTS

| | | | |
|---|---|---|---|
| CN | 1759166 | A | 4/2006 |
| CN | 101065469 | A | 10/2007 |
| CN | 102037107 | | 4/2011 |
| JP | 5 230482 | | 9/1993 |
| JP | 2000 501126 | | 2/2000 |
| JP | 2001 262176 | | 9/2001 |
| JP | 2004 155873 | | 6/2004 |
| JP | 2005 154760 | | 6/2005 |
| JP | 2006 117852 | | 5/2006 |
| JP | 2006 117854 | | 5/2006 |
| JP | 2008 37963 | | 2/2008 |
| JP | 2008 179662 | | 8/2008 |
| JP | 2009 249496 | | 10/2009 |
| JP | 2010 180277 | | 8/2010 |
| JP | 2011 168677 | | 9/2011 |
| WO | 2004 074414 | | 9/2004 |

OTHER PUBLICATIONS

International Search Report Issued Feb. 19, 2013 in PCT/JP12/079742 Filed Nov. 16, 2012.
Office Action issued Apr. 27, 2015, in corresponding Chinese Patent Application No. 201280056146.7, (with English-language Translation).
Combined Office Action and Search Report issued Sep. 30, 2015 in Chinese Patent Application No. 201280056146.7 (with English language translation and English translation of Category of Cited Documents).

* cited by examiner

*Primary Examiner* — Vishal Vasisth
(74) *Attorney, Agent, or Firm* — Oblon, McClelland, Maier & Neustadt, L.L.P

(57) ABSTRACT

A lubricating oil composition for a transmission includes a base oil in a range of 1 mass % to 80 mass %, the base oil having a kinematic viscosity at 40 degrees C. in a range of 0.5 $mm^2/s$ to 20 $mm^2/s$ and a viscosity index of 200 or more. Since the composition exhibits a high viscosity index and a high shear stability, the composition is suitable for a continuously variable transmission.

9 Claims, No Drawings

LUBRICANT OIL COMPOSITION FOR TRANSMISSIONS

This application is a 371 of PCT/JP2012/079742, filed Nov. 16, 2012.

TECHNICAL FIELD

The present invention relates to a lubricating oil composition for a transmission.

BACKGROUND ART

Recently, as a transmission used in an automobile and the like, a metallic-belt-type continuously variable transmission and a toroidal continuously variable transmission have been developed and been already in practical use. In a lubricating oil used in such continuously variable transmissions, it is sought to reduce a viscosity and increase a viscosity index in order to improve an energy-saving property. On the other hand, since a lubricating oil with a low initial viscosity is easily affected by viscosity reduction caused by shearing, a small viscosity reduction caused by shearing is desired.

Accordingly, there has been proposed a lubricating oil having an energy-saving property and a shear stability that are balanced by simultaneously using a base oil having a relatively high viscosity and an shear-resistant viscosity index improver. For instance, Patent Literatures 1 to 3 each disclose a lubricating oil composition in which a small viscosity reduction by shearing is achieved by increasing a viscosity of a base oil and using PMA (polymethacrylate) or OCP (olefin copolymer) having a low molecular weight.

CITATION LIST

Patent Literature(s)

Patent Literature 1: JP-A-2006-117852
Patent Literature 2: JP-A-2001-262176
Patent Literature 3: JP-A-2008-37963

SUMMARY OF THE INVENTION

Problems to be Solved by the Invention

In a lubricating oil used in a continuously variable transmission, recently, a high viscosity index has been sought in order to improve an energy-saving property and, further, a high shear stability has been demanded for securing a pump discharge pressure. However, in the lubricating oil disclosed in Patent Literatures 1 to 3, the viscosity index is not sufficiently improved. In particular, it is difficult to improve fuel consumption during travel at low temperatures. Moreover, when the lubricating oil is added with a viscosity index improver having a large molecular weight, viscosity reduction by shearing is increased.

An object of the invention is to provide a lubricating oil composition for a transmission having a high initial viscosity index and a high shear stability.

Means for Solving the Problems

In order to solve the above-mentioned problems, the invention provides a lubricating oil compositions for a transmission as follows.

(1) According to an aspect of the invention, a lubricating oil composition for a transmission includes a base oil in a range of 1 mass % to 80 mass %, the base oil having a kinematic viscosity at 40 degrees C. in a range of 0.5 $mm^2/s$ to 20 $mm^2/s$, and the lubricating oil composition having a viscosity index of 200 or more.

(2) In the lubricating oil composition for a transmission according to the above aspect of the invention, the lubricating oil composition has a kinematic viscosity at 100 degrees C. in a range of 0.5 $mm^2/s$ to 10 $mm^2/s$.

(3) The lubricating oil composition for a transmission according to the above aspect of the invention further includes polyalphaolefin having a kinematic viscosity at 100 degrees C. in a range of 50 mm2/s to 200 mm2/s.

(4) The lubricating oil composition for a transmission according to the above aspect of the invention further includes at least one of an antiwear agent, an extreme pressure agent, a friction modifier and a viscosity index improver.

(5) In the lubricating oil composition for a transmission according to the above aspect of the invention, the lubricating oil composition is used for a continuously variable transmission.

According to the above aspect of the invention, a lubricating oil composition for a transmission having a high initial viscosity index and a high shear stability can be provided. Accordingly, the lubricating oil composition for a transmission according to the above aspect of the invention is suitable particularly for a continuously variable transmission (CVT).

DESCRIPTION OF EMBODIMENT(S)

A lubricating oil composition for a transmission according to an exemplary embodiment (hereinafter, also simply referred to as "the composition") is provided by blending a base oil in a range of 1 mass % to 80 mass %, the base oil having a kinematic viscosity at 40 degrees C. in a range of 0.5 $mm^2/s$ to 20 $mm^2/s$, and the lubricating oil composition having a viscosity index of 200 or more. The composition will be described below in detail.

As the base oil of the composition, a base oil having a kinematic viscosity at 40 degrees C. in a range of 0.5 $mm^2/s$ to 20 $mm^2/s$ is used. When the kinematic viscosity at 40 degrees C. is less than 0.5 $mm^2/s$, lubricity is insufficient. When the kinematic viscosity at 40 degrees C. exceeds 20 $mm^2/s$, an energy-saving property is poor.

The base oil may be mineral oil or synthetic base oil. A type of the base oil is not particularly limited, but may be suitably selected from any mineral oil and synthetic oil that have been conventionally used as a base oil of a lubricating oil for an automobile transmission.

Examples of the mineral-oil-based base oil are a paraffin-group-based mineral oil, an intermediate-group-based mineral oil and a naphthene-group-based mineral oil. Examples of the synthetic-oil-based base oil are polyalphaolefin (PAO), polybutene, polyol ester, dibasic acid ester, phosphate ester, polyphenyl ether, polyglycol, alkylbenzene and alkylnaphthalene. Examples of PAO described above are an α-olefin homopolymer and an α-olefin copolymer. One of the above base oils may be singularly used or a combination of two or more thereof may be used.

Moreover, among the above mineral-oil-based base oil, kerosene and light oil are suitably usable as a mineral-oil-based base oil having a low viscosity.

The composition is provided by blending the above base oil in a range of 1 mass % to 80 mass % based on a total amount of the composition.

When a blending percentage of the base oil is less than 1 mass %, advantageous effects of the invention are not sufficiently exhibited. On the other hand, when the blending percentage of the base oil is more than 80 mass %, an amount of the polymer to be added is decreased, resulting in an unfavorable decrease in the viscosity index. Accordingly, the blending percentage of the base oil is preferably in a range of 10 mass % to 70 mass %, more preferably in a range of 30 mass % to 70 mass %, further preferably in a range of 50 mass % to 70 mass %.

A kinematic viscosity at 100 degrees C. of the composition is preferably in a range of 0.5 $mm^2/s$ to 10 $mm^2/s$.

When the kinematic viscosity at 100 degrees C. of the composition is less than 0.5 $mm^2/s$, lubricity may become insufficient. On the other hand, when the kinematic viscosity at 100 degrees C. of the composition is more than 10 $mm^2/s$, an energy-saving property may be decreased. Accordingly, the kinematic viscosity at 100 degrees C. of the composition is more preferably in a range of 3 $mm^2/s$ to 9 $mm^2/s$, further preferably in a range of 5 $mm^2/s$ to 8 mm2/s.

The composition is provided by blending the above base oil at a predetermined amount and exhibits a viscosity index of 200 or more.

When the viscosity index is less than 200, the lubricating oil exhibits a high temperature-dependence of viscosity although exhibiting a high shear stability, resulting in a poor practical use. Accordingly, the viscosity index of the composition is preferably 210 or more, more preferably 220 or more.

In order to set the viscosity index at 200 or more, a base oil having a high viscosity index may be used, but it is more effective to blend a viscosity index improver (VII). Examples of the viscosity index improver are: non-dispersed polymethacrylate, dispersed polymethacrylate, olefin copolymer, dispersed olefin copolymer, and styrene copolymer. As the viscosity index improver, for instance, the dispersed and non-dispersed polymethacrylates each preferably have a mass average molecular weight of 5000 to 300000. Moreover, the olefin copolymer preferably has a mass average molecular weight of 800 to 100000. One of the above viscosity index improver may be singularly used or a combination of two or more thereof may be used.

A content of the viscosity index improver is not particularly limited, but is preferably in a range of 0.5 mass % to 15 mass %, more preferably in a range of 1 mass % to 10 mass %.

The composition preferably includes polyalphaolefin having a kinematic viscosity at 100 degrees C. in a range of 50 $mm^2/s$ to 200 $mm^2/s$ (PAO having a high viscosity).

It becomes easy to adjust a final viscosity of the lubricating oil composition by blending such a PAO having a high viscosity (high molecular weight). Moreover, blending a PAO having a high viscosity contributes to improvement in the viscosity index of the composition. When the kinematic viscosity at 100 degrees C. of PAO to be blended is less than 50 $mm^2/s$, the lubricating oil exhibits a high temperature-dependence of viscosity although exhibiting a high shear stability, resulting in a poor practical use. When the kinematic viscosity at 100 degrees C. of the composition is more than 200 $mm^2/s$, a viscosity of the entire composition excessively increases, so that the energy-saving property may be deteriorated. Accordingly, the kinematic viscosity at 100 degrees C. of the PAO to be blended is more preferably in a range of 65 $mm^2/s$ to 180 $mm^2/s$, further preferably in a range of 80 $mm^2/s$ to 150 $mm^2/s$.

A content of the above PAO is preferably in a range of 5 mass % to 30 mass %, more preferably in a range of 7 mass % to 25 mass % based on the total amount of the composition.

The composition may include various additives described below as long as the advantageous effects of the invention are not hampered. Specifically, a pour point depressant (PPD), an antiwear agent, an extreme pressure agent, a detergent dispersant, a friction modifier and the like may be suitably blended for use.

The pour point depressant is exemplified by polymethacrylate (PMA) having a mass average molecular weight of 5000 to 50000. One of the pour point depressant may be singularly used or a combination of two or more thereof may be used. A content of the pour point depressant is not particularly limited, but is preferably in a range of 0.1 mass % to 2 mass %, more preferably in a range of 0.1 mass % to 1 mass % based on the total amount of the composition.

The antiwear agent and the extreme pressure agent are each exemplified by a sulfur compound and a phosphorus compound. Examples of the sulfur compound are olefin sulfide, sulfurized fat and oil, ester sulfide, thiocarbonates, dithiocarbamates and polysulfides. Examples of the phosphorus compound are phosphite esters, phosphate esters, phosphonate esters and an amine salt thereof or a metallic salt thereof. One of each of the antiwear agent and the extreme pressure agent may be singularly used or a combination of two or more of each of those may be used.

A content of each of the antiwear agent and the extreme pressure agent is not particularly limited, but is preferably in a range of 0.1 mass % to 20 mass % based on the total amount of the composition.

As the detergent dispersant, an ashless dispersant and a metal detergent are usable.

Examples of the ashless dispersant are a succinimide compound, a boron imide compound, a Mannich dispersant and an acid amide compound. One of the ashless dispersant may be singularly used or a combination of two or more thereof may be used. A content of the ashless dispersant is not particularly limited, but is preferably in a range of 0.1 mass % to 20 mass % based on the total amount of the composition. Examples of the metal detergent are alkali metal sulfonate, alkali metal phenate, alkali metal salicylate, alkali metal naphthenate, alkaline earth metal sulfonate, alkaline earth metal phenate, alkaline earth metal salicylate, and alkaline earth metal naphthenate. One of the metal detergent may be singularly used or a combination of two or more thereof may be used. A content of the metal detergent is not particularly limited, but is preferably in a range of 0.1 mass % to 10 mass % based on the total amount of the composition.

Examples of the friction modifier are fatty acid ester, fatty acid amide, fatty acid, aliphatic alcohol, aliphatic amine and aliphatic ether. Specifically, the friction modifier is exemplified by a friction modifier having at least one alkyl group having 6 to 30 carbon atoms or alkenyl group having 6 to 30 carbon atoms in a molecule. For instance, oleic acid and oleylamine are preferably used. One of the friction modifier may be singularly used or a combination of two or more thereof may be used.

A content of the friction modifier is not particularly limited, but is preferably in a range of 0.01 mass % to 2 mass %, more preferably in a range of 0.01 mass % to 1 mass % based on the total amount of the composition.

EXAMPLE

Next, the invention will be further described in detail with reference to Examples and Comparatives, which by no means limit the invention.

Examples 1-10, Comparatives 1-2

Lubricating oil compositions were respectively prepared according to blending compositions shown in Table 1 and defined as sample oils. Properties and performance of each of the sample oils were obtained according to the following methods.

(1) Flash Point

Measurement was conducted based on JIS K 2265.

(2) Kinematic Viscosity (40 degrees C., 100 degrees C.)

Measurement was conducted based on JIS K 2283.

(3) BF Viscosity

Measurement was conducted based on JPI-5S-26-85.

(4) Ultrasonic Shear Stability Test (Sonic Test)

Measurement was conducted based on JPI-5S-29-88 (measurement temperature: 40 degrees C. and 100 degrees C., irradiation time: 1 hour). Kinematic viscosities and viscosity indexes before and after the sonic test are shown in Table 1.

TABLE 1

| | | | | Example 1 | Example 2 | Example 3 | Example 4 | Example 5 | Example 6 |
|---|---|---|---|---|---|---|---|---|---|
| Composition of Sample Oil (mass %) | Kerosene A | | | 10.00 | — | — | — | — | — |
| | Kerosene B | | | — | 11.00 | — | — | — | — |
| | Kerosene C | | | — | — | 15.00 | — | — | — |
| | Light oil | | | — | — | — | 15.00 | — | — |
| | Isoparaffin | | | — | — | — | — | 20.00 | — |
| | Paraffin A | | | — | — | — | — | — | 20.00 |
| | Paraffin B | | | — | — | — | — | — | — |
| | PAO (low molecular weight) | | | — | — | — | — | — | — |
| | Gr. II base oil having low viscosity | | | 49.31 | 48.31 | 44.31 | 44.31 | 39.31 | 39.31 |
| | Gr. II base oil A having high viscosity | | | — | — | — | — | — | — |
| | Gr. II base oil B having high viscosity | | | — | — | — | — | — | — |
| | PAO (high molecular weight) | | | 20.00 | 20.00 | 20.00 | 20.00 | 20.00 | 20.00 |
| | VII (molecular weight: 30000) | | | 10.00 | 10.00 | 10.00 | 10.00 | 10.00 | 10.00 |
| | VII (molecular weight: 160000) | | | — | — | — | — | — | — |
| | Other additives | | | 10.69 | 10.69 | 10.69 | 10.69 | 10.69 | 10.69 |
| | Total | | | 100.00 | 100.00 | 100.00 | 100.00 | 100.00 | 100.00 |
| Evaluation Result | Flash point | COC | ° C. | 114 | 112 | 124 | 125 | 130 | 136 |
| | BF viscosity | @−40° C. | mPa · s | 6250 | 7150 | 8000 | 8100 | 8200 | 6570 |
| | Initial kinematic viscosity | @40° C. | $mm^2/s$ | 29.92 | 27.96 | 28.99 | 29.31 | 32.37 | 30.00 |
| | | @100° C. | $mm^2/s$ | 7.347 | 6.985 | 7.113 | 7.163 | 7.537 | 7.285 |
| | Kinematic viscosity after Sonic test | @40° C. | $mm^2/s$ | 29.9 | 27.9 | 28.9 | 29.3 | 32.3 | 29.8 |
| | | @100° C. | $mm^2/s$ | 7.34 | 6.9 | 7.1 | 7.1 | 7.49 | 7.2 |
| | Reduction ratio of kinematic viscosity | @40° C. | % | 0.00 | 0.00 | 0.00 | 0.00 | 0.50 | 0.70 |
| | | @100° C. | % | 0.00 | 0.00 | 0.00 | 0.00 | 0.90 | 0.80 |
| | Initial viscosity index | | — | 227 | 228 | 224 | 223 | 213 | 222 |
| | Viscosity index after Sonic test | | — | 226 | 227 | 222 | 222 | 211 | 222 |

| | | | | Example 7 | Example 8 | Example 9 | Example 10 | Comp. 1 | Comp. 2 |
|---|---|---|---|---|---|---|---|---|---|
| Composition of Sample Oil (mass %) | Kerosene A | | | — | — | — | — | — | — |
| | Kerosene B | | | — | — | — | — | — | — |
| | Kerosene C | | | — | — | — | — | — | — |
| | Light oil | | | — | — | — | — | — | — |
| | Isoparaffin | | | — | — | — | — | — | — |
| | Paraffin A | | | — | — | — | — | — | — |
| | Paraffin B | | | 58.81 | — | — | — | — | — |
| | PAO (low molecular weight) | | | — | 59.31 | — | — | — | — |
| | Gr. II base oil having low viscosity | | | — | — | 66.21 | 57.91 | — | — |
| | Gr. II base oil A having high viscosity | | | — | — | — | — | 84.81 | — |
| | Gr. II base oil B having high viscosity | | | — | — | — | 10.00 | — | 87.61 |
| | PAO (high molecular weight) | | | 20.50 | 20.00 | 7.40 | 7.40 | — | — |
| | VII (molecular weight: 30000) | | | 10.00 | 10.00 | 15.70 | 14.00 | — | — |
| | VII (molecular weight: 160000) | | | — | — | — | — | 4.50 | 1.70 |
| | Other additives | | | 10.69 | 10.69 | 10.69 | 10.69 | 10.69 | 10.69 |
| | Total | | | 100.00 | 100.00 | 100.00 | 100.00 | 100.00 | 100.00 |
| Evaluation Result | Flash point | COC | ° C. | 146 | 164 | 180 | 180 | 220 | 230 |
| | BF viscosity | @−40° C. | mPa · s | 8320 | 6610 | 7800 | 6000 | 8400 | 30000 |
| | Initial kinematic viscosity | @40° C. | $mm^2/s$ | 29.30 | 31.41 | 29.30 | 30.20 | 32.60 | 41.00 |
| | | @100° C. | $mm^2/s$ | 7.150 | 7.355 | 7.150 | 7.280 | 7.291 | 7.200 |
| | Kinematic viscosity after Sonic test | @40° C. | $mm^2/s$ | 28.7 | 31.2 | 28.4 | 29.7 | 29.2 | 38.3 |
| | | @100° C. | $mm^2/s$ | 7.0 | 7.3 | 7.0 | 7.2 | 6.185 | 6.53 |
| | Reduction ratio of kinematic viscosity | @40° C. | % | 1.10 | 0.60 | 1.60 | 1.56 | 10.50 | 6.60 |
| | | @100° C. | % | 1.50 | 0.90 | 1.90 | 1.58 | 15.30 | 9.30 |
| | Initial viscosity index | | — | 223 | 212 | 223 | 220 | 199 | 139 |
| | Viscosity index after Sonic test | | — | 221 | 211 | 223 | 219 | 168 | 124 |

Kerosene A

A commercially available product was used (flash point: 44 degrees C., kinematic viscosity at 40 degrees C.: 0.892 $mm^2/s$).

Kerosene B

A commercially available product was used (flash point: 42 degrees C., kinematic viscosity at 40 degrees C.: 0.987 $mm^2/s$).

Kerosene C

A commercially available product was used (flash point: 84 degrees C., kinematic viscosity at 40 degrees C.: 1.621 $mm^2/s$).

Light Oil

A commercially available product was used (flash point: 84 degrees C., kinematic viscosity at 40 degrees C.: 1.660 $mm^2/s$, kinematic viscosity at 100 degrees C.: 0.805 $mm^2/s$, viscosity index: 30).

Isoparaffin

An isoparaffinic base oil was used (flash point: 87 degrees C., kinematic viscosity at 40 degrees C.: 2.560 $mm^2/s$).

Paraffin A

A paraffinic base oil was used (flash point: 101 degrees C., kinematic viscosity at 40 degrees C.: 2.166 $mm^2/s$).

Paraffin B

A paraffinic base oil was used (flash point: 138 degrees C., kinematic viscosity at 40 degrees C.: 4.320 $mm^2/s$, kinematic viscosity at 100 degrees C.: 1.540 $mm^2/s$, viscosity index: 83).

PAO Having Low Molecular Weight

A commercially available product was used (flash point: 156 degrees C., kinematic viscosity at 40 degrees C.: 5.100 $mm^2/s$, kinematic viscosity at 100 degrees C.: 1.800 $mm^2/s$, viscosity index: 128).

Base Oil Having Low Viscosity

A base oil of API Group 2 was used (flash point: 170 degrees C., kinematic viscosity at 40 degrees C.: 7.680 $mm^2/s$, kinematic viscosity at 100 degrees C.: 2.278 $mm^2/s$, viscosity index: 108).

Base Oil A Having High Viscosity

A base oil of API Group 2 was used (flash point: 212 degrees C., kinematic viscosity at 40 degrees C.: 20.500 $mm^2/s$, kinematic viscosity at 100 degrees C.: 4.500 $mm^2/s$, viscosity index: 116).

Base Oil B Having High Viscosity

A base oil of API Group 2 was used (flash point: 222 degrees C., kinematic viscosity at 40 degrees C.: 30.600 $mm^2/s$, kinematic viscosity at 100 degrees C.: 5.200 $mm^2/s$, viscosity index: 104).

PAO Having High Molecular Weight

A commercially available product was used (flash point: 283 degrees C., kinematic viscosity at 40 degrees C.: 1240 $mm^2/s$, kinematic viscosity at 100 degrees C.: 100.0 $mm^2/s$, viscosity index: 170).

Viscosity Index Improver (VII)

Polymethacrylate (Mw: 30,000)

Polymethacrylate (Mw: 160,000)

Other Additives

An additive package for a transmission oil provided by mixing the extreme pressure agent, antiwear agent, detergent dispersant, pour point depressant and friction modifier was used.

Evaluation Results

In the sample oils in Examples 1 to 10 of the invention, the initial viscosity index exceeded 200, which showed an excellent initial property. The kinematic viscosity and the viscosity index were not so decreased even after the sonic test. This means that the sample oils of the invention exhibit an extremely excellent shear stability and are stably usable for a long period of time. Moreover, the BF viscosity was low, which shows an excellent low-temperature property.

On the other hand, since the sample oils in Comparatives 1 and 2 did not contain the base oil of the invention having a predetermined low viscosity, the initial viscosity index of each of the sample oils was low and shear stability thereof was poor. Moreover, a low temperature property thereof was also poor.

Although the base oils (e.g., kerosene and light oil) having a low flash point were used in Examples 1 to 4, the flash point finally reached 100 degrees C. or more, so that the sample oils of Examples 1 to 4 were sufficient for use.

The invention claimed is:

1. A lubricating oil composition, comprising:

a base oil in a range of from 50 mass % to 80 mass %; and polyalphaolefin in a range of from 7 mass % to 25 mass %;

wherein:

the base oil has a kinematic viscosity at 40° C. of from 0.5 $mm^2/s$ to 20 $mm^2/s$;

the polyalphaolefin has a kinematic viscosity at 100° C. of from 80 $mm^2/s$ to 150 $mm^2/s$;

the lubricating oil composition has a viscosity index of from 210 to 228; and the lubricating oil composition has a kinematic viscosity at 100° C. of from 6.985 $mm^2/s$ to 8 $mm^2/s$.

2. The lubricating oil composition according to claim 1, further comprising:

at least one of an antiwear agent, an extreme pressure agent, and a friction modifier.

3. The lubricating oil composition according to claim 1, which is suitable for a continuously variable transmission.

4. The lubricating oil composition according to claim 1, wherein the base oil is present in the lubricating oil composition in an amount of 50 mass % to 70 mass %.

5. The lubricating oil composition according to claim 1, comprising a viscosity index improver in an amount of 0.5 mass % to 10 mass %.

6. The lubricating oil composition according to claim 1, comprising at least one of a pour point depressant and a detergent dispersant.

7. The lubricating oil composition according to claim 5, wherein the viscosity index improver is present in the lubricating oil composition in an amount of 1 mass % to 10 mass %.

8. The lubricating oil composition according to claim 1, wherein the lubricating oil composition has a viscosity index of from 220 to 228.

9. The lubricating oil composition according to claim 1, wherein the lubricating oil composition has a BF viscosity of 6,000 to 8,320 mPa·s.

* * * * *